United States Patent [19]

Milton et al.

[11] Patent Number: 5,001,402

[45] **Date of Patent: * Mar. 19, 1991**

[54] ILLUMINATED AERIAL MARKER

[76] Inventors: Richard M. Milton, 5004 Ft. Clark, Austin, Tex. 78745; Daniel C. Barnes, 6002 Diamond Head Dr., Austin, Tex. 78746

[ * ] Notice: The portion of the term of this patent subsequent to Jun. 13, 2006 has been disclaimed.

[21] Appl. No.: 361,409

[22] Filed: Jun. 5, 1989

Related U.S. Application Data

[63] Continuation of Ser. No. 67,367, Jun. 29, 1987, Pat. No. 4,839,567, which is a continuation-in-part of Ser. No. 945,398, Dec. 23, 1986, abandoned.

[51] Int. Cl.[5] ..... H01J 15/04

[52] U.S. Cl. ..... 315/344; 315/76; 315/227 R; 315/208; 315/248; 313/54; 313/631

[58] Field of Search ..... 315/185 S, 208, 241 S, 315/248, 344, 76, 227 R; 313/54, 631

[56] References Cited

U.S. PATENT DOCUMENTS 4,839,567 6/1989 Milton et al. ..... 315/344

*Primary Examiner*—Eugene R. LaRoche
*Assistant Examiner*—Michael B. Shingleton
*Attorney, Agent, or Firm*—Thomas E. Sisson

[57] ABSTRACT

An illuminated aerial marker for a high voltage transmission line using a spherical colored opaque capacitor with gas filled lamps electrically connected, exterior to the capacitor with one electrode of the lamps connected to the high voltage source and the other to the conductive area of the capacitor or capacitors. The lamps are spaced and sized to provide illumination with nighttime conspicuity of at least 4,000 feet when the lamps are activated.

8 Claims, 1 Drawing Sheet

ILLUMINATED AERIAL MARKER

This application is a continuation of coopending U.S. patent application Ser. No. 067,367, filed June 29, 1987, entitled An Illuminated Aerial Marker, now U.S. Pat. No. 4,839,567, (incorporated herein by reference) which is a continuation-in-part application of now abandoned U.S. patent application Ser. No. 945,398 filed Dec. 23, 1986.

BACKGROUND OF THE INVENTION

This invention relates to aerial markers, and more particularly to markers having various configurations of neon lamps that cooperate with the exterior of colored spherical balls designed as capacitors to provide daytime and nighttime conspicuity of at least 4000 feet when the lamps are activated.

Many miles of high voltage transmission lines are constructed to be elevated to sufficient height, relative to the surrounding terrain, to minimize ground vehicle contact with the line. These lines are not easily visible from the air and present a hazard to low-flying aircraft. It is common to mark these transmission lines in strategic locations; the markers being spherical shaped fiberglass shells with a highly visible color to increase daytime visibility. It would, of course, be quite desireable to increase nighttime visibilty by illumination.

Existing technology includes a single neon tube encased inside a transparent tube filled with conductive fluid with one electrode of the neon tube connected to the high voltage source and the other to a rod of a precise, and considerable, length supported parallel to the high voltage source. U.S. Pat. No. 3,124,712 discloses the use of a high voltage source to operate a neon lamp but uses a light pervious rather than opaque enclosure, a single tube, and a rectifier to cause flashing of the single tube.

SUMMARY OF THE INVENTION

The present invention uses a capacitor which may be a spherical shell with embedded conductive sections with neon lamps external to the spherical shell. One electrode of the neon lamp is connected directly to the high voltage source through a clamp. The other electrode of the neon lamp attaches to the conductive portions of the spherical shell capacitor. A low cost spherical capacitor, variously made by embedding strips of conductive glass, metal, or a paint coating inside the shell of the sphere, may be used to support neon lamps external to the shell, making a marker of excellent visibility. The neon lamps are closely adjacent to the outer shell of the spherical, light-impervious, colored capacitor 30" in diameter. Eight (8), 27" long, 10 mm diameter lamps with 10 mm pressure neon electrically hooked in parallel and placed physically parallel at ½" interval spacing on a spherical capacitor result in brilliant illumination. Various other gasses may be selected for lamp color depending on their application. Such an arrangement will give a highly effective oscillating light and is conspicious at 5000' to 10,000', whereas ten lamps of the same construction spaced 4" apart reduce illumination to a level barely noticeable at 3000'.

There are numerous Variations in length of neon lamps, electrical configuration of the neon lamps and size or multiplicity of capacitors that may be tailor-made for differing voltages of the high voltage sources and to produce either steady or an oscillating or dancing light.

The present invention places the neon or gas filled lamps closely adjacent to an active high voltage source allowing operation of neon lamps in parallel. Laboratory tests have shown that a plurality of lamps in parallel must be in a high voltage field as well as having a voltage applied across the lamps for the lamps to oscillate. Further, lamps must be in the field of a high voltage capacitor as well as having voltage applied across the lamps for the lamps to oscillate. Further yet, lamps must be properly configured on a spherical shell to reduce field cancellation effects to achieve the needed illumination to satisfy FAA standards for conspicuity.

DETAILED DESCRIPTION OF THE PREFERRED EMBODIMENT

Figure 1:
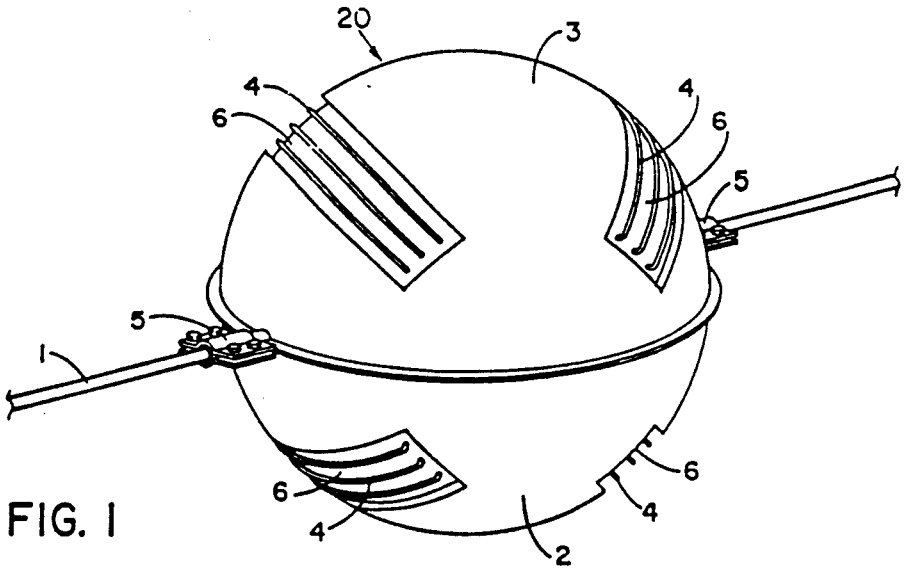
FIG. 1 is a perspective view of one embodiment of the present invention.

FIG. 1 illustrates a first embodiment of the present invention. The high voltage source 1 is a transmission line. Two halves 2 and 3 of the spherical capacitor 20 are shown. The capacitor 20 is the size, shape and coloring of existing marker balls used for daytime visibilty. Capacitor 20 may be constructed of fiberglass with a conductive inner layer or conductive paint covering most of the inner portion but leaving a sufficient area around the clamps to insulate the conductive inner layer from the high voltage source 1. The instant invention has been shown effective in a voltage range from 69 Kv to 650 Kv. The two halves 2 and 3 may be electrically insulated so that there are then two capacitors. Gas filled lamps 4 may be used on both capacitors or the two halves (2 and 3) may be electrically connected to have one capacitor and gas filled lamps 4 used only on the top half 3 or only on the bottom half 2 or on both halves 2 and 3. A reflective tape 6 may be used under the gas filled lamps 4. The tape and lamps may be covered with a plastic shield (not shown) or simply plastic coated. A simple clamp 5 clamps over protrusions of the halves of the shell 2 and 3. An electrical connection between one clamp 5 and high voltage source 1 effectively eliminates corona and failure of the shell therefrom Spacing of the gas filled lamps 4 is such as to have capacitive coupling of the gas filled lamps 4 for maximum illumination.

The length, placement, conductivity of the gas, configuration of a lamp, type of electrode, diameter of lamp tube, electrical and physical relation of lamps to each other, and how these considerations affect the capacitance of the capacitor by varying the flux and static fields when placed external to the spherical capacitor 20 determine the performance of the marker ball as an illuminator. These relationships ultimately affect the brilliance of the lamp or lamps 4, the oscillation rate, and the brilliance or intensity of the oscillation. These mechanical, physical, and electrical arrangements are designed to offer the maximum illumination.

The field created by current flow through the lamps 4 interacts with the field of the shell 20 changing the effective shell capacitance. The flow of electricity depends upon applied voltage and resistance in a circuit. The resistance, which is normally called impedance when a capacitor is in a circuit, varies with current frequency and effective size of the shell capacitor. Normally the frequency is 60 cycles and does not change appreciably. With lamps of sufficient length, spread evenly over the shell of the spherical balls or in close proximity to the high voltage source 1, the field caused by instant flow of current through the lamps may effectively decrease the shell capacitor strength so as to increase impedance in the circuit so the lamps will not give sufficient illumination.

Proper placement, size and electrical hookup allows current flow through the lamps to cause sufficient light emission but the same current flow increases impedance sufficiently in the circuit so that current flow through the lamps is reduced and light emission decreases. Now this reduction in current flow through the lamps allows an instant effective increase in the spherical capacitor thereby reducing circuit impedance causing increased current flow through the lamps; therefore it has been found possible to produce an oscillating or dancing light. Other configurations of lamps allow a continuous light because there is not sufficient circuit impedance change to dim the light emission.

The sphere diameter may be varied only a small amount to increase light emitted from the tubes. For example increasing the sphere diameter from 15" to 17" gives approximately 50% more light on the same voltage line. Thus, it is possible to vary sphere diameter and neon tube configuration to give optimum illumination on differing voltage lines.

The embodiment of FIG. 1 is designed to be clamped to a high voltage transmission line in the usual manner for daytime aerial markers.

A split spherical colored fiberglass shell 20 with projections on each half of the split shell is designed to be used for clamping the shell to the line. Another connecting means may be a preformed lashing rod which attaches the shell to the line.

Conductive strips may be embedded within the shell 20 which may cover the major portion of the shell interior (a commercially available product which is a mat of conductive fibers called ROMOGLAS may be conveniently used); however, metallic rods or screens either embedded or fitting closely to the shell could also be used as well as a conductive paint coating. The metallic conductors within the sphere are themselves connected but are insulated from the high voltage source; this may be conveniently accomplished by the configuration within the sphere.

One or more sets of neon lamps 4 are attached exterior to the upper half of the shell 20 with each set almost encircling the shell. Each tube within the set is electrically connected in series The sets are then electrically connected in parallel with one side of the parallel connection electrically connected with the high voltage source 1 and the other side connected with the conductive area within the shell with a resulting oscillation of the illumination of the lamps when the lamps are in both the high voltage field and the field of the capacitor. When the sets are electrically connected in series a steady illumination is achieved. All connections may be made within the shell with openings for the connectors sealed with a plastic sealer.

Up to eight 27" neon tubes may be hooked in series in each of several sets and the sets then hooked in parallel, giving excellent illumination with a continuously oscillating or dancing light when used with a 30" spherical capacitor and a 345 KVA (phase-to-phase) high voltage (60 cycle) source.

On a 36" spherical capacitor, two sets of lamps have been arranged by using one continuous lamp 10'-12' long and zig-zagging it back and forth to form five legs, each approximately 24"-29" in length and having approximately ½" interval spacing between the legs.

Figure 2:
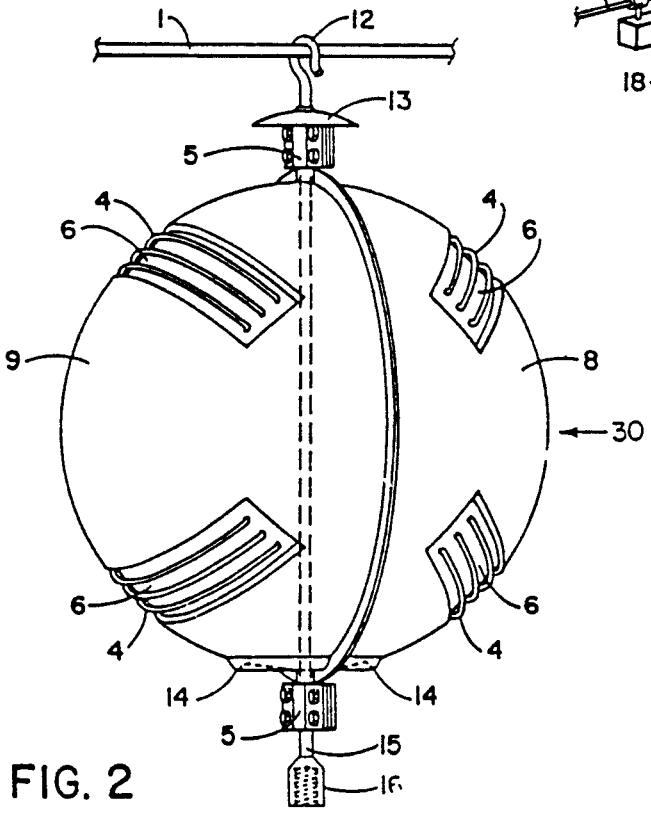
FIG. 2 is a perspective view of an alternative embodiment of the present invention.

FIG. 2 illustrates an alternative embodiment 30 with the halves 8 and 9, somewhat different in shape than those shown in FIG. 1, clamped over a conductor 15 with clamps 5. Gas filled lamps 4 are mounted over reflective tape 6 in the same way as shown in FIG. 1. The reflective tape 6 may be replaced with a reflective paint. A hook or clamp 12 is attached to high voltage source 1 and tighten in place. A threaded end 16 of the conductor 15 is used when the unit is hung on an energized high voltage source 1 using a "hot stick." A rain deflector 13 for the top clamp 5 and a ridged protrusion 14 to keep flowing water off the electrical connections through the other clamp 5 are shown in FIG. 2.

The embodiment of FIG. 2 is made essentially the same as the first embodiment of FIG. 1 by clamping the two halves 8 and 9 of the shell 30 around a metallic conductor 15 with a "duckbill" type bracket to secure the shell on the high voltage source (wire) on one end and a female fitting to connect to a "hot stick" on the other. In the embodiment of FIG. 2 the neon lamps were arranged on the upper part of each half in order to give maximum visibility from above the unit. The sphere may be comprised of two or more segments with electrical insulation from each other to form separate capacitors.

It has been found that lamps may dim during a heavy rain. This is prevented by any of several modifications to keep dry the electrical connections and the electrical insulating area between the high voltage source and metallic conductive portion of the capacitor. All connections to the neon lamps may be made inside the spherical capacitor with openings to the exterior plastic sealed. A drip lip or gutter-type extension to the shell may drain exterior water away from insulating areas between the high voltage source and the capacitor.

Figure 3:
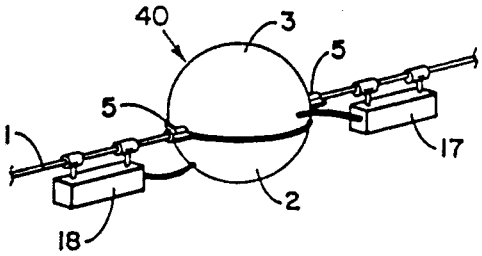
FIG. 3 is a perspective view of yet another alternative embodiment of the present invention.

FIG. 3 illustrates the versatility and flexibility of the present invention. Gas filled lamps are placed within clear enclosures 17 and 18 and are of a different shape and may be of different length than gas filled lamps 4. In one embodiment of the present invention approximately twelve feet of 10 mm diameter, 10 mm pressure neon lamping was helically coiled within each enclosure. The enclosure's location at a distance of approximately one foot from the spherical capacitor halves 2 and 3 does result in a nonoscillating light. Note that an electrode on one end of each gas filled lamp within enclosures 17 and 18 is electrically connected to the high voltage source 1 but each electrode in the other end of the gas filled lamps is electrically connected with the conductive area within the halves 2 and 3. The gas filled lamps in enclosures 17 and 18 are mounted within the field of the high voltage source 1 separated from but closely associated with spherical capacitor 40.

Many other embodiments of the invention may be visualized. Maximum illumination may be achieved by varying the length of the neon tubes in series, the number of these in parallel and the size of the capacitor. A spherical shape is not necessary for good illuminations but is preferred by FAA and gives a maximum capacitor for the space. It has been found that with a 30" spherical capacitor, a 138 KVA power source, 10 tubes two feet long spaced 4" apart on the upper half of the capacitor and with all tubes electrically connected in parallel there is very little light emitted because of cancellation of field effect. However, the same 10 tubes, placed ½" apart, connected electrically in parallel on the same size capacitor on the same 138 KVA line gave a brilliant oscillating light. In such an installation the multiple tubes provide for continued light emission even if some of the tubes fail, perhaps by breakage.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

What is claimed is:

1. An illuminated aerial marker for use on a high voltage source comprising:

an opaque spherical insulating shell attachable to said high voltage source, said shell having a conductive member inside said shell whereby said shell forms a spherical capacitor;

a plurality of gas filled lamps mounted in close proximity to the exterior of said spherical capacitor with said lamps electrically connected at a first end of said lamps to said high voltage source and electrically connected at a second end of said lamps to said conductive member inside said shell, said lamps spaced and sized to provide illumination with nighttime conspicuity of at least 4,000 feet when said lamps are activated.

2. The marker of claim 1 wherein a portion of said lamps provide oscillating illumination said portion being in both the field of said high voltage source and the field of said capacitor.

3. The marker of claim 1 wherein said lamps are electrically connected in series with said high voltage source and said conductive member, said illumination being continuous.

4. The marker of claim 1 wherein said image are arranged in sets, said lamp within said sets being electrically connected in series, said sets being electrically connected in parallel with said high voltage source and said conductive member.

5. The marker of claim 1 wherein said conductive member is a conductive coating deposited on the inside surface of said shell.

6. The marker of claim 1 wherein said conductive member is a glass fiber mat integrally connected with said shell.

7. The marker of claim 1 wherein said lamps are in depressions of the exterior of said shell and covered with a transparent material.

8. The marker of claim 1 further comprising a waterproofing member protecting said interior of said shell and the exterior electrical connections.

* * * * *